United States Patent [19]

Shaw

[11] Patent Number: 4,974,640

[45] Date of Patent: Dec. 4, 1990

[54] METHOD FOR REMOVING A LOOSE INCORRECT PIECE OF WEFT THREAD FROM THE SHED ON WEAVING MACHINES

[75] Inventor: Henry Shaw, Vleteren, Belgium

[73] Assignee: Picanol N.V., Belgium

[21] Appl. No.: 321,834

[22] Filed: Mar. 10, 1989

[30] Foreign Application Priority Data

Mar. 10, 1988 [BE] Belgium ..... 8800270

[51] Int. Cl.[5] ..... D03J 1/04

[52] U.S. Cl. ..... 139/116 A

[58] Field of Search ..... 139/116 A, 1 R, 450, 139/435, 116 R

[56] References Cited

U.S. PATENT DOCUMENTS 4,502,512 3/1985 Suzuki et al. ..... 139/116 A
4,529,010 7/1985 Aarts ..... 139/116 A

FOREIGN PATENT DOCUMENTS 0207470 1/1987 European Pat. Off. .
290383 11/1988 European Pat. Off. ..... 139/116 A
2248353 5/1975 France .
223340 12/1984 Japan ..... 139/116 A

*Primary Examiner*—Henry S. Jaudon
*Attorney, Agent, or Firm*—Bacon & Thomas

[57] ABSTRACT

A method for removing a loose incorrectly inserted piece of weft thread from the shed in a weaving machine includes the steps of inserting a weft thread into the shed and transporting it through the shed until it extends over the entire length of the shed in order to from a pulling thread. The loose weft thread is then fastened, outside the shed, to the pulling thread. The pulling thread is drawn together with the piece of weft thread fastened to it from the end of the shed located opposite to the end at which the fastening occurred in such a way that the latter piece of weft thread is removed from the fell line in the form of a loop and thereby removed from the shed.

16 Claims, 15 Drawing Sheets

Fig. 9
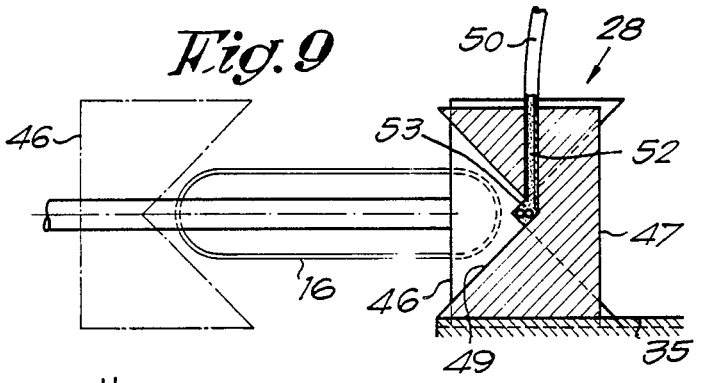
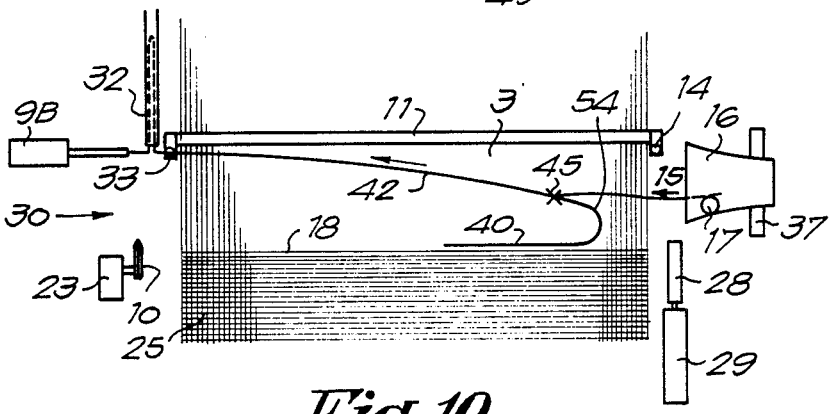
Fig. 10
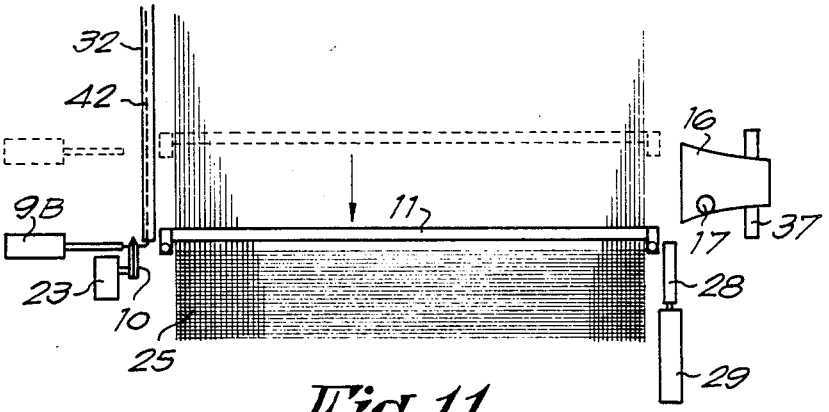
Fig. 11

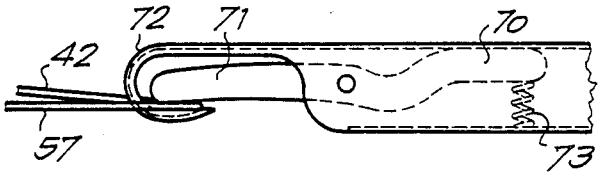
Fig. 24
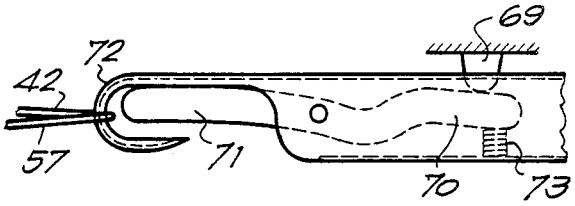
Fig. 25
Fig. 26
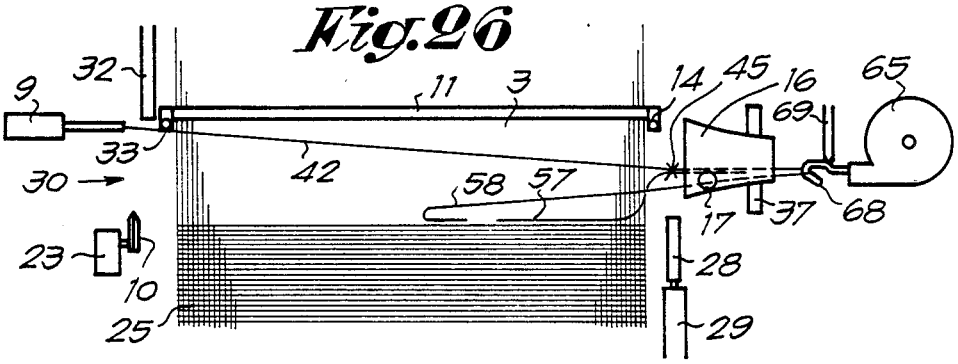
Fig. 27
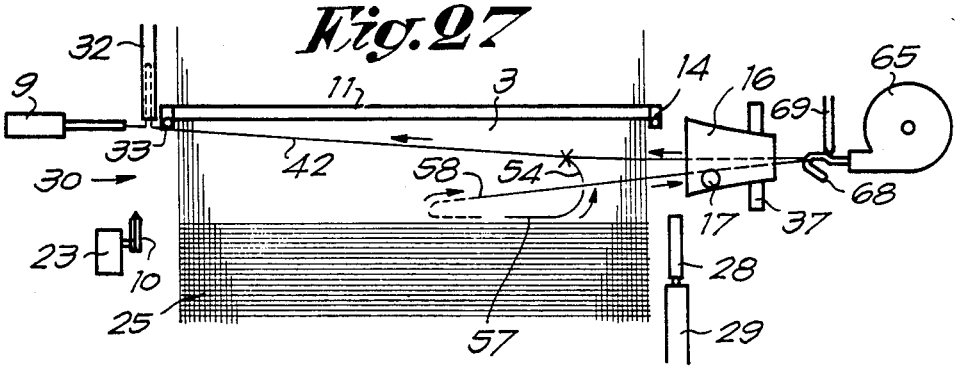
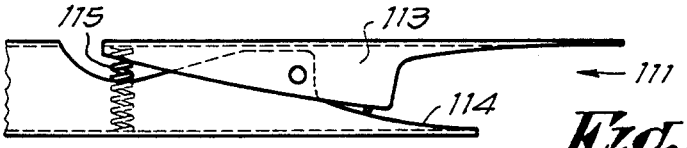
Fig. 29

80
89
98
106
11
3
103
15
85
97
74
64
55
58
57
75
106
105
28
25

80
89
98
85
106
11
3
15
64
74
97
55
58
57
75
106
105
28
25

80
89
98
85
106
11
3
15
42
74
97
64
58
55
57
75
106
105
28
25

80
89
98
85
106
11
3
15
42
74
64
97
58
55
57
45
75
28
106
105
25

80
98
85
89
106
11
3
15
45
55
74
64
97
42
58
57
75
105
28
25

80
98
89
106
11
3
15
85
74
64
97
58
75
106
116
105
28
25

80
98
85
89
106
11
3
103
15
69
42
74
97
64
55
58
57
75
63
44
106
28
105
25

80
98
85
89
106
11
3
103
15
69
74
97
42
64
55
75
63
58
57
44
106
28
25
105

80
98
85
89
106
11
3
103
69
74
97
42
55
58
57
45
75
15
28
106
44
105
25

80
98
85
89
106
11
3
103
112
69
74
97
42
55
58
57
45
64
75
106
44
28
105
25

80
98
85
89
106
11
3
45
103
112
69
74
97
42
54
57
58
64
75
105
28
25

80
98
85
89
106
11
3
103
69
74
97
42
45
57
54
58
105
28
25

METHOD FOR REMOVING A LOOSE INCORRECT PIECE OF WEFT THREAD FROM THE SHED ON WEAVING MACHINES

BACKGROUND OF THE INVENTION

This invention concerns a method for removing a loose incorrect piece of weft thread from the shed on weaving machines, in other words a piece of weft thread that is no longer connected to the supply of weft thread.

In particular the invention concerns a method for removing from the shed loose incorrect pieces of weft thread which are not bound in the warp threads and which have at least one end outside the shed and which may or may not have already been beaten up. By these are meant in the first place broken-off pieces of weft thread.

A method for the faultless removal from the shed of an incorrect piece of weft thread has been described in Dutch patent application No. 8602191 of applicant whereby a piece of weft thread which has already been beaten-up is first released from the fell line and then removed from the shed. The essence of this method is that the incorrect piece of weft thread remains connected to the weft thread supply, that if the piece of weft thread has already been bound in by the warp threads in binding is undone and that subsequently a new weft thread is inserted into the shed. The new weft thread carries, during insertion into the shed, the incorrect piece of weft thread with it, so that the latter is pulled free in the form of a loop and subsequently removed from the shed on the side which lies opposite the weft insertion side. The fact that the incorrect piece of weft thread is released in the form of a loop means that only a limited force need be exercised to pull the thread free away from the fell line and remove it from the shed.

The aforementioned method has as disadvantage that it is only suitable for the removal of pieces of weft thread which are still connected to the weft thread supply. Weft thread pieces which have already been separated from the weft thread supply and broken-off weft thread pieces which run from the middle of the shed to beyond one end of the shed cannot be removed from the shed by means of the aforementioned known method.

SUMMARY OF THE INVENTION

The object of the present invention is thus a method in which the aforementioned disadvantage is systematically excluded.

To this end the invention concerns a method for removing a loose incorrect piece of weft thread from the shed in weaving machines, in particular a loose incorrect piece of weft thread which is not bound in by the warp threads and which has at least one end outside the shed, including the steps of inserting and transporting through the shed a pulling thread until the pulling thread extends over the entire length of the shed; fastening outside the shed the incorrect loose piece of weft thread which is to be removed to the pulling thread; and drawing from the shed, from the end of the shed located opposite to the end where the aforementioned incorrect piece of weft thread has been fastened to the pulling thread, this the pulling thread together with the aforementioned incorrect piece of weft thread fastened to it, so that the latter is released from the fell line in the form of a loop and removed from the shed. By preference the pulling thread and aforementioned piece of weft thread are fastened to one another directly next to the relevant end of the shed. As the loose incorrect piece of weft thread can be released from the fell line in the form of a loop by aforementioned method, only a limited pulling force need be applied to the pulling thread.

In a special embodiment a combination is made, in the event of a weft thread break resulting in the creation of two pieces of weft thread in the shed, of the method described above and the method described in Dutch patent application No. 8602191 of applicant for the removal of both pieces of weft thread from the shed. Here, as described in Dutch patent application No. 8602191, the piece of weft thread which is closest to the weft insertion side of the shed and which is still connected to the weft thread supply is first released in loop form by the insertion of at least one new length of weft thread and transported with it to the opposite side of the shed. As a result a piece of weft thread is created which extends from the weft thread supply through the entire shed and which can serve as a pulling thread for the removal of the loose incorrect piece of weft thread. To this end according to the method of the present invention the loose incorrect piece of weft thread is fastened on the opposite side of the shed from the weft insertion side to the pulling thread formed as described above, followed by the withdrawal on the weft insertion side of the pulling thread together with the incorrect piece of weft thread fastened to it.

BRIEF DESCRIPTIONS OF THE DRAWINGS

With a view to illustrating the characteristics according to the invention more clearly, a number of preferred embodiments are described below but without being in any way exhaustive and with reference to the attached drawings where:

Figure 8:
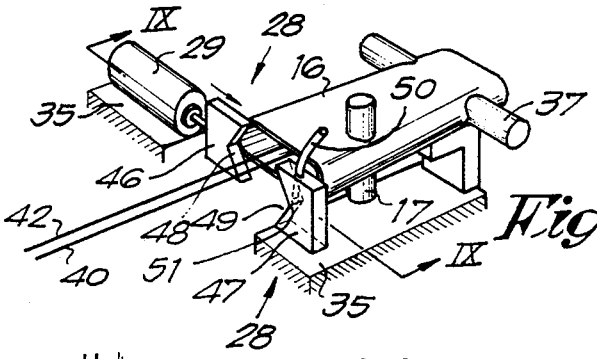
Figure 12:
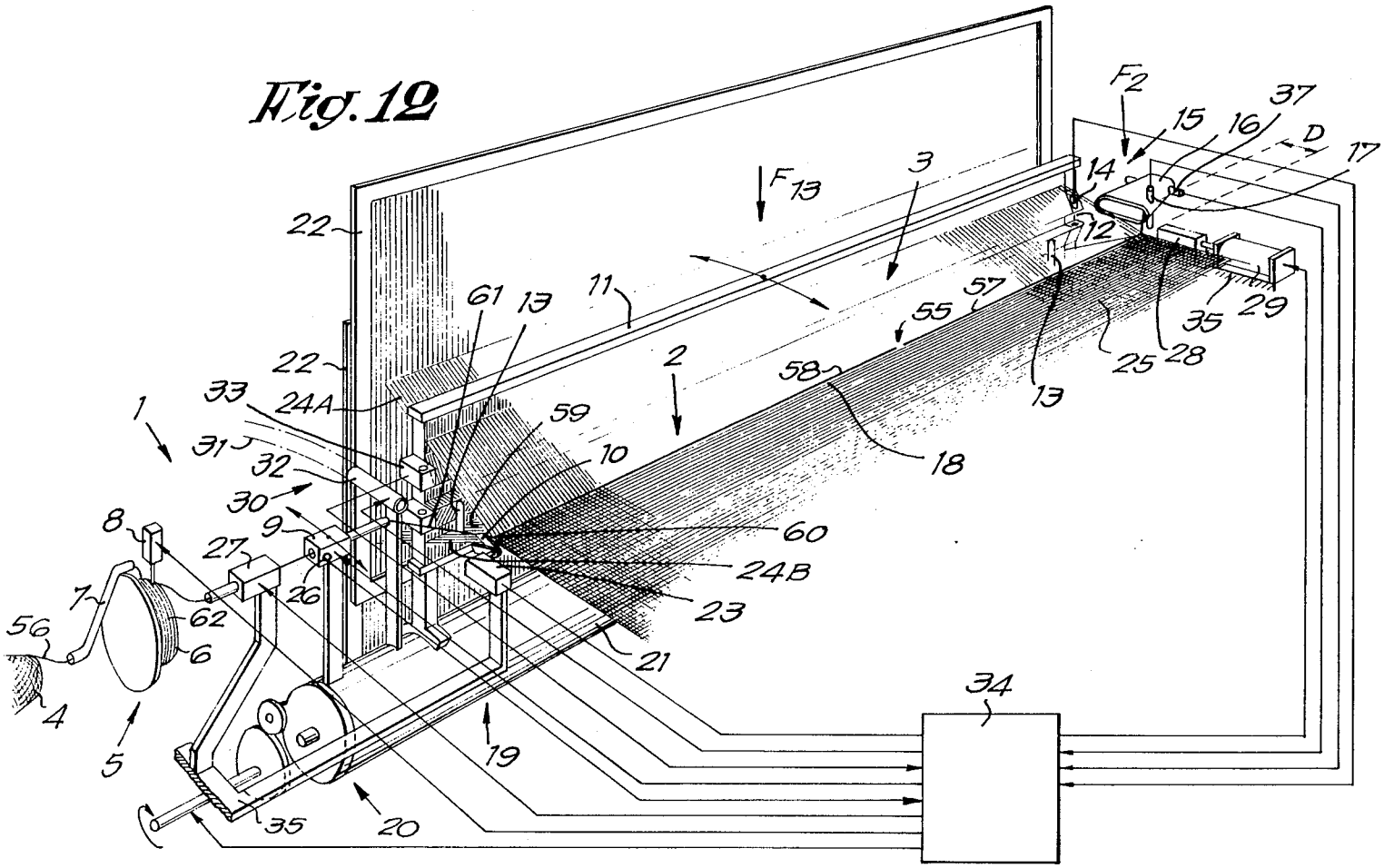
Figure 20:
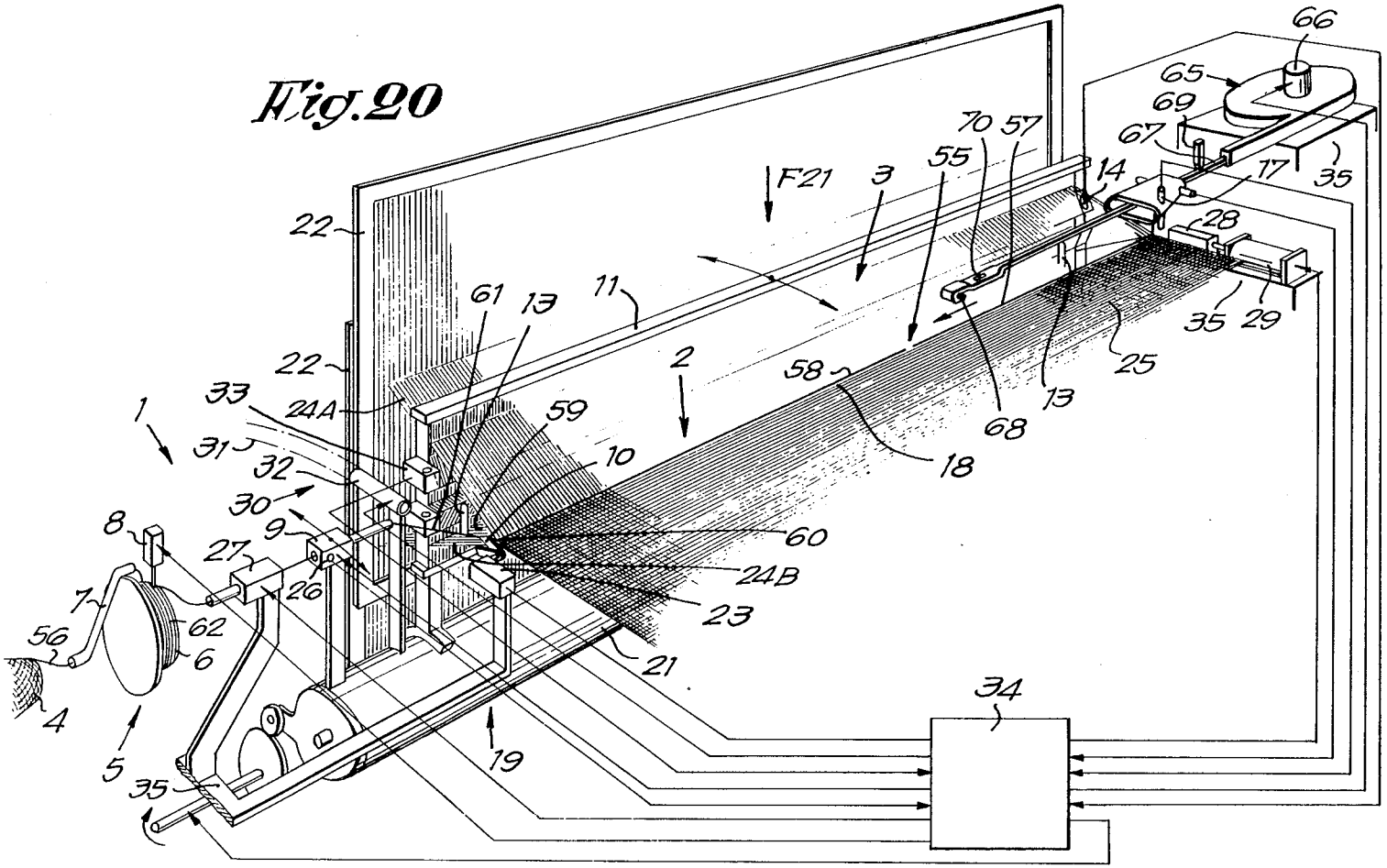
Figure 41:
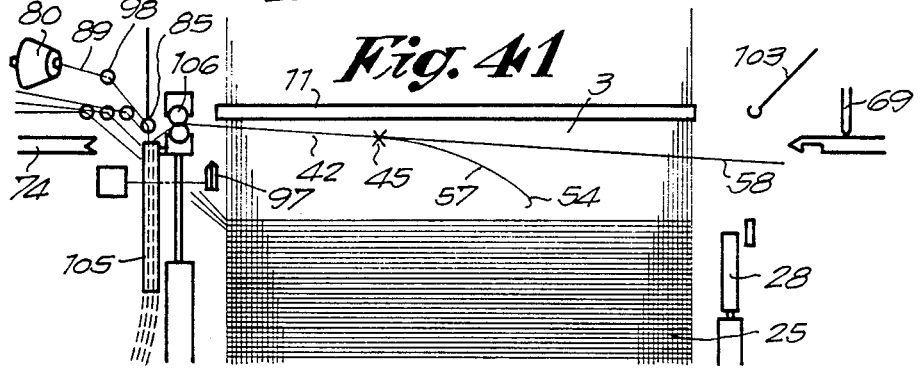
Figure 42:
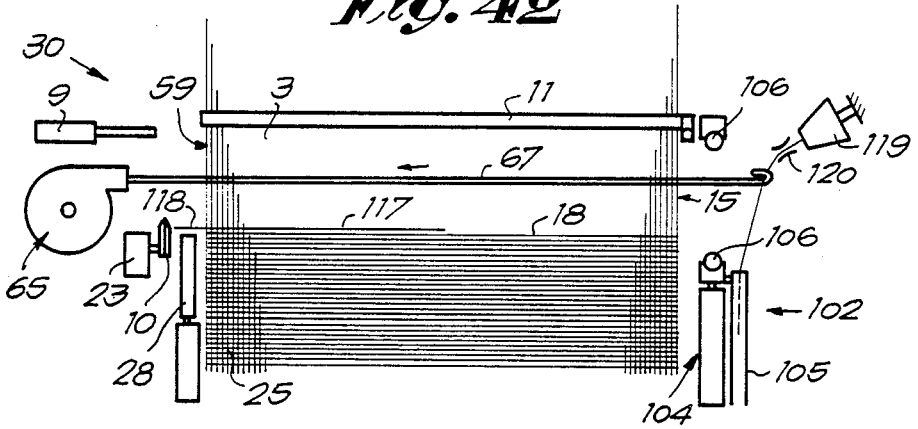
Figure 43:
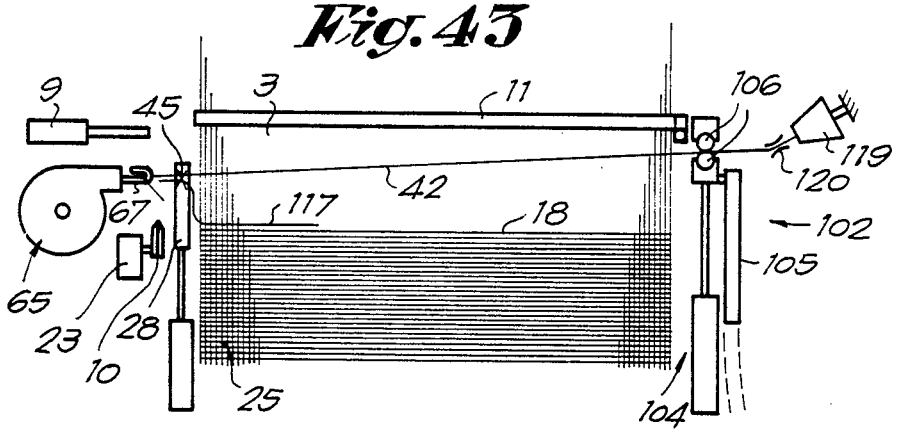
Figure 44:
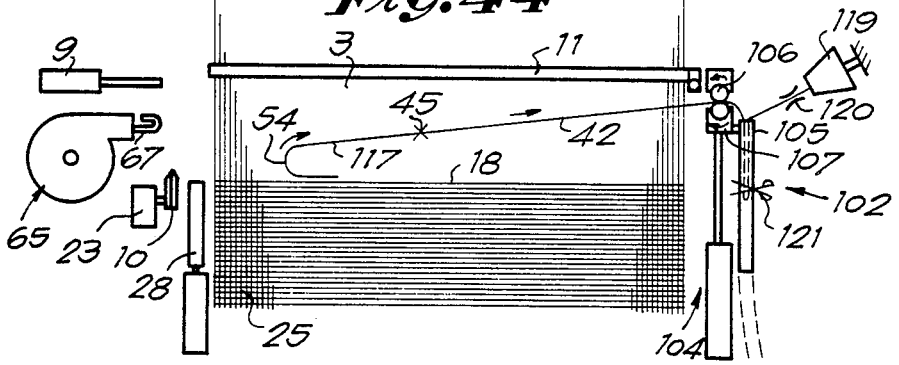

FIGS. 3 to 11 inclusive show step by step the method according to the invention for an airjet weaving machine, where FIGS. 8 and 9 show one particular possibility for the fastening to one another of aforementioned pieces of weft thread;

FIG. 12 shows the situation after the breakage of a weft thread in the middle of the shed;

FIGS. 13 to 19 inclusive refer to the removal of the pieces of weft thread of the incorrect weft thread in FIG. 12;

FIG. 20 shows a variant of the invention where use is made of a thread carrying element for carrying the pulling thread through the shed;

FIGS. 21 to 27 inclusive show step by step the method according to the invention in the event that use is made of the thread carrying element, where FIGS. 24 and 25 show on a larger scale the free end of such a thread carrying element in two different positions; FIGS. 28 to 41 inclusive refer to the method of the invention applied to a gripper weaving machine; FIGS. 42 to 44 inclusive show yet another particular embodiment of the invention.

DETAILED DESRIPTIONS OF THE PREFERRED EMBODIMENTS

Figure 1:
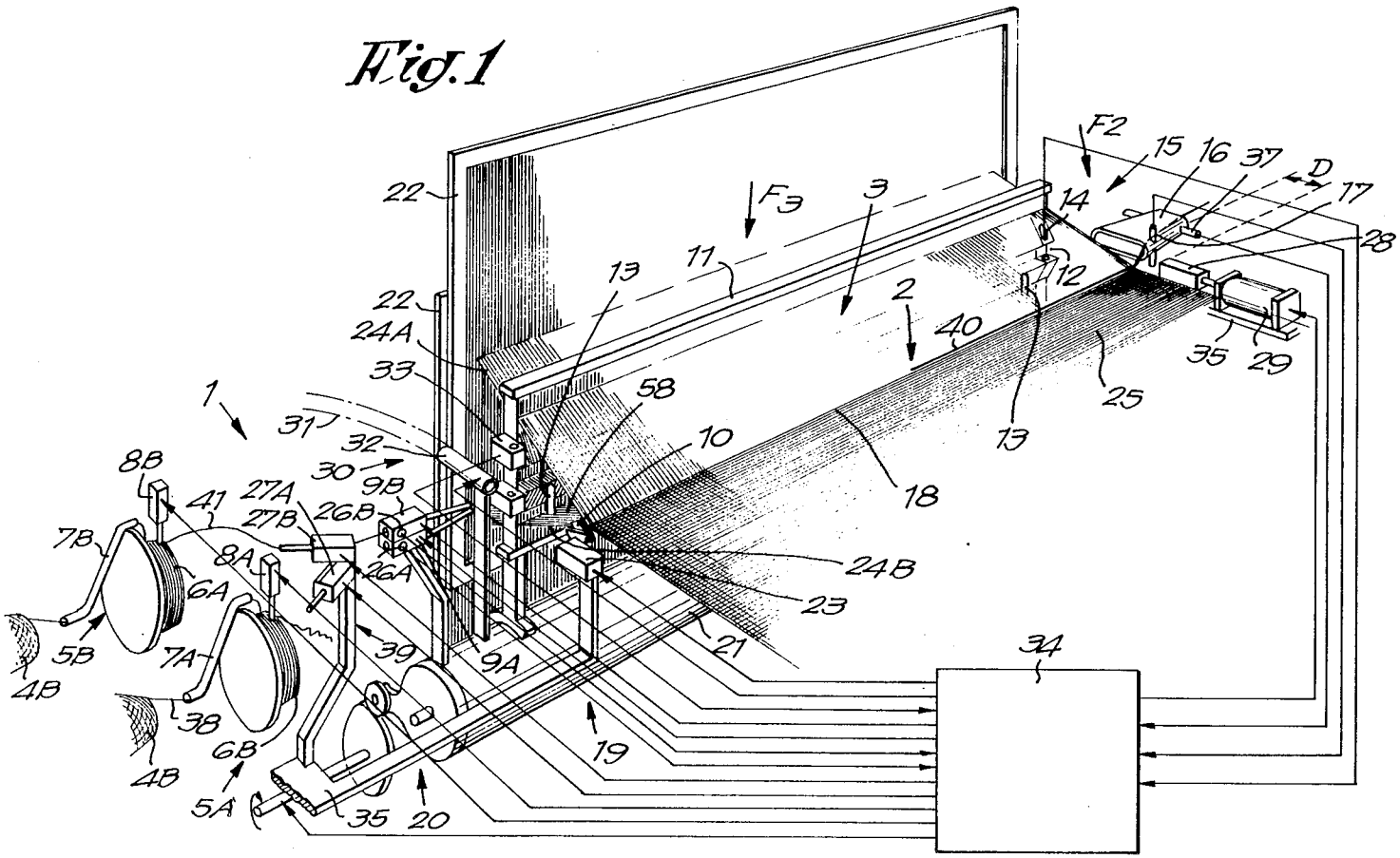
FIG. 1 shows the situation for an airjet weaving machine as it is after the breakage of a weft thread before the shed.

In FIG. 1 a device 1 is shown for the preparation and insertion of weft threads 2 in the shed 3 of airjet weaving machines. Those elements which are known in the art will only be briefly noted. In the weaving machine of FIG. 1, use is made of one or more thread supplies, respectively 4A and 4B; their prewinders 5A and 5B which both consist principally of a fixed winding drum, 6A and 6B respectively, a rotating winding arm 7A and 7B and a thread blocking device 8A and 8B which can stop or release turns; one or more main nozzles 9A and 9B; a weft cutter 10; a U-shaped reed 11 with a thread transport channel 12; auxiliary nozzles 13; a first weft sensor or thread detector 14 for the detection of the arrival of a weft thread 2 at the end 15 of the shed 3; a suction nozzle 16 for catching an inserted weft thread 2 by its front end and/or removing thread residues; and a second weft sensor or thread detector 17 installed in the suction nozzle 16 for detecting broken weft threads or excessively long weft threads after these have been beaten up by the reed 11 against the fell line 18. Similarly in FIG. 1 the batten 19, the cam drive 20 of the batten shaft 21, the heald frames 22, the drive 23 of aforementioned weft cutter 10, the upper warp 24A, the lower warp 24B, the woven fabric 25, thread detectors 26A and 26B which monitor the presence of the thread in the thread channels of the main nozzles 9A and 9B and the counter nozzles 27A and 27B are also indicated. The weft cutter 10 is by preference electrically driven, such as for example is described in Belgian patent application No. 8700224 of applicant, by which the operation of the weft cutter 10 can be very precisely controlled in relation to the weft data.

Furthermore use can be made, as is indicated among other things in the embodiment of FIG. 1, of a fastening apparatus 28 for the fastening to one another of threads, which is provided with the required driving means 29; means which are mounted next to the weft insertion side 30 of the shed 3 such as for example a suction nozzle 32 connected to a suction line 31, for withdrawing weft thread or pieces of weft thread from the shed 3; a thread detector 33 mounted between the weft insertion side 30 of the shed 3 and the inlet of aforementioned suction nozzle 32 and a control unit 34 for a suitable control of the aforementioned parts, in particular as described further below.

As indicated in the embodiment according to FIG. 1 a number of parts on the one hand, in particular the counter nozzles 27A and 27B, the weft cutter 10 with drive 23, the suction nozzle 16 and the fastening apparatus 28 are mounted on the frame 35 of the weaving machine, while on the other hand the main nozzles 9A and 9B, the suction nozzle 32, the detector 33 and the first weft sensor 14 move with the batten 19.

Figure 2:
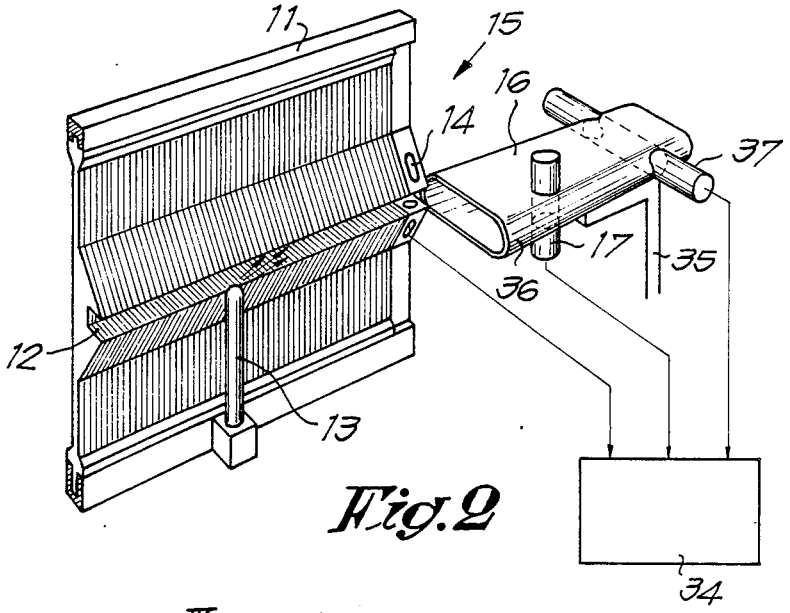
FIG. 2 shows an enlarged view of the section of the area in FIG. 1 indicated by arrow F2.

The arrangement of the weft detectors 14 and 17 and of the suction nozzle 16 is further clarified in FIG. 2. The first weft detector 14 is fastened in a known manner to the end of the thread transport channel 12. The suction nozzle 16 is flattened in the horizontal direction. The second weft detector 17 is located in the forepart of the suction nozzle 16, in particular next to the sidewall 36 closest to the fell line 18, this being so arranged that an excessively long weft thread 2 which is pressed forward by the beating motion of the reed 11, and in particular against sidewall 36, will be detected by weft detector 17.

If the device is not only intended for the removal from the shed of loose incorrect or broken-off pieces of weft thread, but also for the removal of weft thread pieces which are still connected to the supply of weft thread, a third weft detector 37 will by preference be installed at the end 15 of the shed, which as indicated in FIG. 2 monitors the entire passage of the suction nozzle 16.

In FIG. 1 weft thread 38 from thread supply 4A is being used and a break 39 in the weft thread has occurred. As a result a loose incorrect piece of weft thread 40 may be created which extends at least as far as the second weft detector 17 in suction nozzle 16.

Both as a consequence of the fact that the thread detector 26A of the main nozzle 9A no longer detects a thread, and of the fact that aforementioned second weft detector 17 does detect a thread, a signal is generated which indicates the presence of a loose incorrect piece of weft thread 40 and the drive of the weaving machine is stopped. As the weaving machine cannot be stopped instantly, the loose incorrect piece of weft thread 40 will in general already be bound in the warp threads 24A and 24B by the time the weaving machine has stopped. It is obvious that in this case the binding will first have to be undone in the known manner by means of pick finding, after which the batten 19 will be returned to the position away from the fell line 18.

FIGS. 3 to 7 inclusive, as well as FIGS. 10 and 11, show schematically the further course of the method, given for a view according to arrow F3 in FIG. 1.

Figure 3:
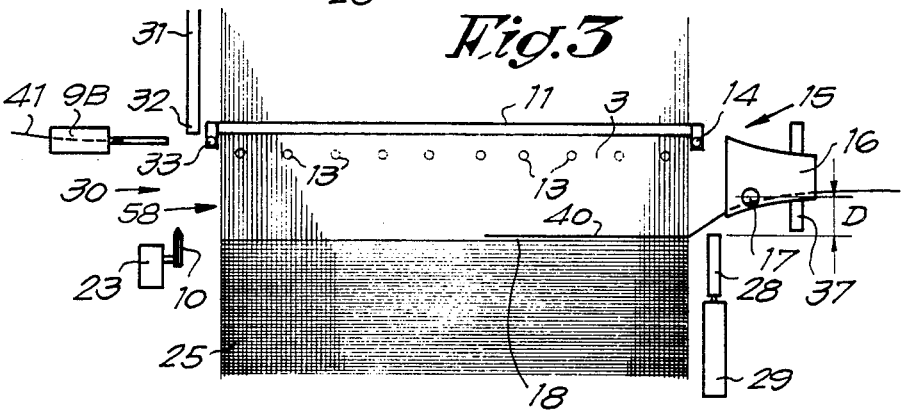

FIG. 3 shows the same situation as in FIG. 1.

Figure 4:
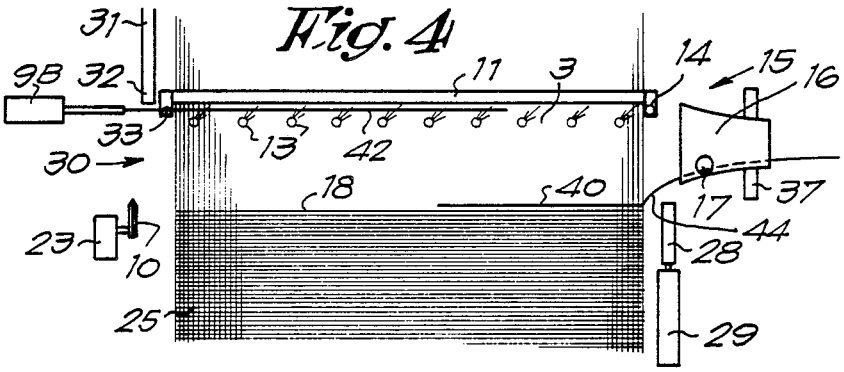
Figure 5:
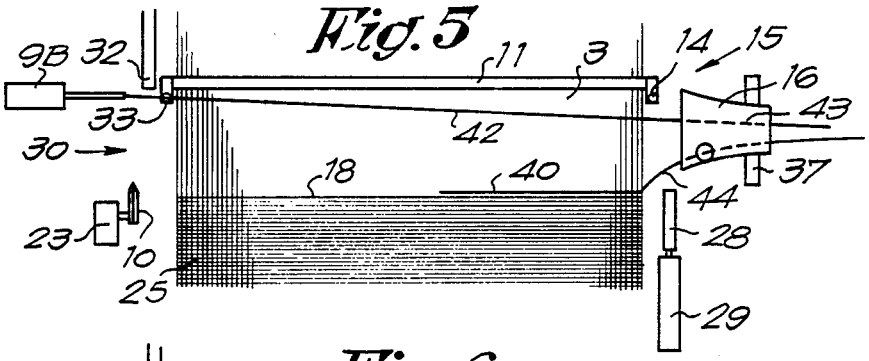

In FIG. 4 weft thread 41 is carried from thread supply 4B by means of the main nozzle 9B and inserted in the shed 3. The quantity of weft thread 41 inserted in shed 3 is referred to below as pulling thread 42. The arrival of the end 43 of the pulling thread 42 at the opposite end 15 of the shed 3 can be for example detected by means of the third weft detector 37 as shown in FIG. 5. This creates a situation whereby the pulling thread 42 extends over the entire shed 3 and even a distance beyond it.

In the foregoing it was pointed out that because of the fact that two weft thread supplies, 4A and 4B respectively, were being used, an immediate changeover could be made in the event of the detection of a thread break 39 from the first thread supply 4A and main nozzle 9A, to the second thread supply 4B, and main nozzle 9B. In this way a pulling thread 42 can be immediately supplied after the detection of the weft thread break 39 without having to wait for the repair of the weft thread 38 and the rethreading of the first main nozzle 9A.

Figure 6:
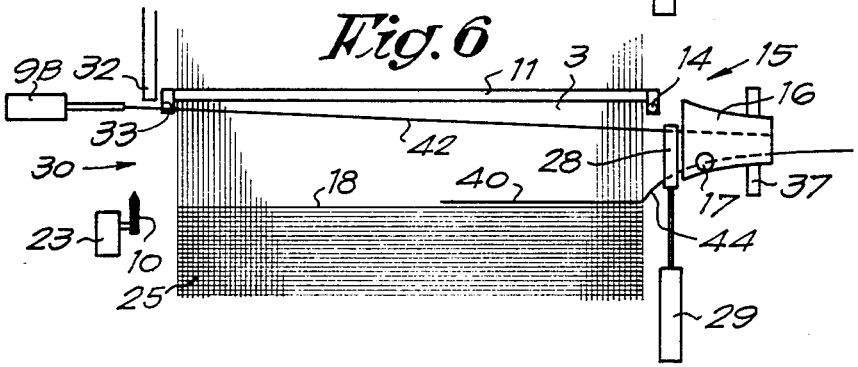

The special nature of this invention consists of the fact that the incorrect loose or broken-off piece of weft thread 40 is released from the fell line 18 in loop form and removed from the shed 3. To this end the end 44 of the incorrect piece of weft thread 40 which is located beyond the end 15 of the shed 3 is fastened to pulling thread 42. To achieve this in the illustrated embodiment the aforementioned fastening apparatus 28 is presented by the driving means 29 next to the end 15 of the shed 3 to the piece of weft thread 40 and the pulling thread 42, as is shown in FIG. 6. The fastening apparatus 28 consists for example of a knotting device, while the driving means 29 for moving the apparatus and/or controlling it consists of a pneumatic cylinder.

It will be clear that preference goes to the location of the fastening apparatus 28 immediately beyond the relevant end 15 of shed 3. In this position the location of the loose incorrect piece of weft thread 40 is after all clearly defined. At a greater distance from the end 15 it may happen that the piece of weft thread 40 will no longer be caught by the fastening apparatus.

Figure 7:
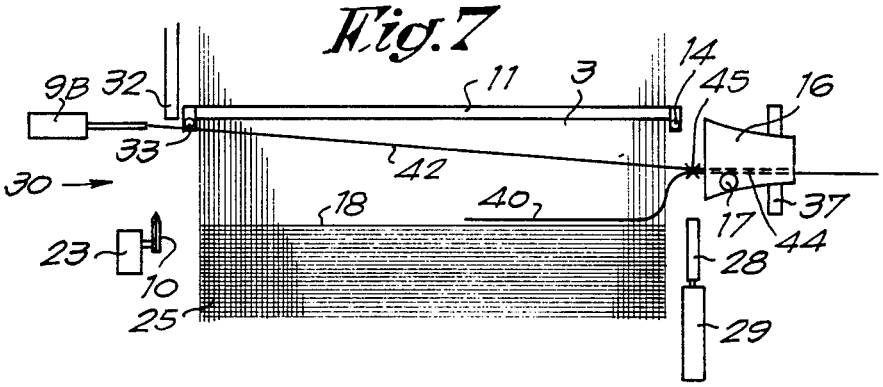

The fastening 45, indicated schematically in FIG. 7, may however be realized in any suitable way whatsoever. The fastening may for example be made by means of a knotting device, by a splice, by using a special fastening agent, etc. The aforementioned special fastening agent may for example consist of a staple, a thread wound round the piece of weft thread 40 and the pulling thread 42, or a drop of wax or fast-setting adhesive applied to the threads being fastened to one another.

By way of clarification FIG. 8 shows how the piece of weft thread 40 and the pulling thread 42 can be fastened to one another by means of fast-setting adhesive. To this end use is made of an fastening apparatus 28 consisting of two elements 46 and 47 which are installed on opposite sides next to the entrance of the suction nozzle 16 and which have V shaped profiles 48 and 49 directed towards one another. The aforementioned driving means 29 of the fastening apparatus 28 in this case consists for example of a pneumatic cylinder permitting the first element 46 to be brought next to the second element 47. Element 47 is permanently mounted on the frame 35 of the weaving machine and is provided with a channel 50 which comes out exactly in the deepest edge 51 of the V shaped profile 49 and through which, as shown in FIG. 9, fast-setting adhesive 52 can be supplied. As is further illustrated in FIG. 9 the piece of weft thread 40 and the pulling thread 42 are fastened to one another by first applying a small quantity 53 via channel 50 of the aforementioned adhesive 52 in the edge 51 of the V shaped profile 49 and subsequently operating the pneumatic cylinder 29 so that the first element 46 is moved next to the second element 47. By its movement the first element 46 carries the piece of weft thread 40 and the pulling thread 42 along with it and pushes these together in the V shaped profile 49 in which the quantity of adhesive 53 has been applied. After the quantity of adhesive 53 has set, elements 46 and 47 can be withdrawn from one another, so that the fastened threads remain behind. In this way the aforementioned threads can be fastened to one another in a quick manner without having to have a precise knowledge of their position in advance.

In the last step of the method the pulling thread 42 is withdrawn from the shed 3 from the weft insertion side 30, whereby the incorrect piece of weft thread 40 fastened to it is also removed. As shown in FIG. 10 the loose incorrect piece of weft thread 40 is released from the fell line 18 in the form of a loop 54, for which only a limited pulling force is required, which is supplied from the suction nozzle 32. While the pulling thread 42 and the piece of weft thread 40 fastened to it are being sucked into the suction nozzle 32 they pass along aforementioned thread detector 33.

Once the pulling thread 42 and the piece of weft thread 40 have been sucked up in the suction nozzle 32, this is detected by the thread detector 33, and the batten 19 is moved forward to its beating position, in particular as shown in FIG. 11. Subsequently the weft cutter 10 or some other means of cutting is operated so that the aforementioned threads 40 and 42 are cut loose from the thread supply 4B and carried away through the suction nozzle 32.

It will be clear that during the performance of the aforementioned method, the counter nozzle 27A and the main nozzle 9A can once again be provided with weft thread, so that the weaving process can be resumed.

It is also clear that the thread supply 4B, the prewinder 5B, the counter nozzle 27B and the main nozzle 9B can belong to the conventional device for the insertion of weft threads. According to a variant embodiment these components can also be conceived of in such a way that they are exclusively intended for supplying a pulling thread 42. In the latter case it is possible to work with an exceptionally strong type of thread, so that any break in it is virtually impossible.

In FIG. 12 the case of a weft thread break 55 in the shed 3 is illustrated.

In the illustrated embodiment only a single weft thread 56 is used. Consequently in FIG. 12 only one weft thread supply 4, one prewinder 5, one counter nozzle 27 and one main nozzle 9 are shown.

Following a weft thread break 55 an incorrect loose piece of weft thread 57 is created, as well as an incorrect piece of weft thread 58 which is connected via end 59 on the weft thread insertion side 30 of the shed 3 to the thread supply 4. The first object of the invention is the removal of the piece of weft thread 57. Preferably a method is provided whereby a combination is made of the removal of the piece of weft thread 58 and the removal of the piece of weft thread 57, in particular as described below.

The broken-off piece of weft thread 57, which extends further than normal because of the thread break 55, is detected by means of a second weft detector 17, located at a distance D in front of the fell line 18, even before beating-up, or at the very last at the moment of beating-up itself.

As a result of the signal from the second weft detector 17 the drive 23 of the weft cutter 10 is temporarily cut off in order to prevent the piece of weft thread 57 being cut loose. The drive of the weaving machine is also stopped, by preference with the batten 19 in its rearmost position. As the batten 19 moves backward the main nozzle 9, which as aforementioned is mounted on the batten, will also undergo a backwards motion, so that the distance between the main nozzle 9 and the beginning 60 of the fell line 18 is increased. In order to prevent the piece of weft thread 61 from breaking between the prewinder 5 and the shed 3 as a result of the increase in this distance, a number of turns 62 are released from the prewinder 5. In order to prevent the released turns 62 being prematurely inserted into the shed 3, the aforementioned counter nozzle 27 is activated.

It will be clear that if the incorrect weft thread 2 has already been bound in by the warp threads 24A and 24B, the binding will first have to be undone in the known way by means of pick finding, so that the incorrect weft thread 2 is set free.

Figure 13:
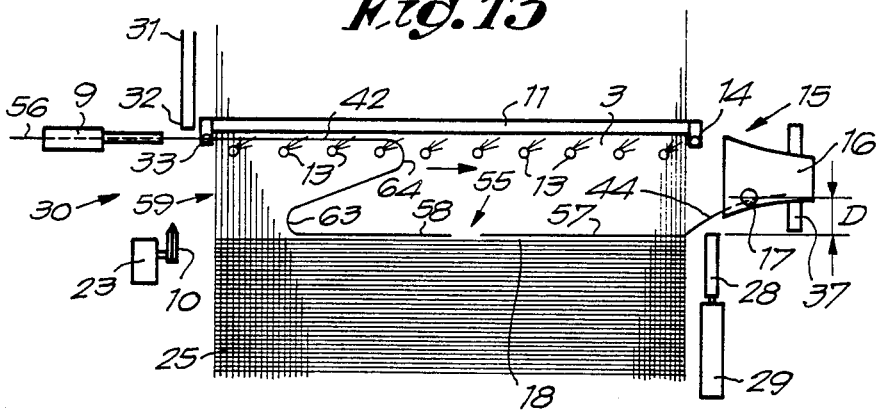
Figure 14:
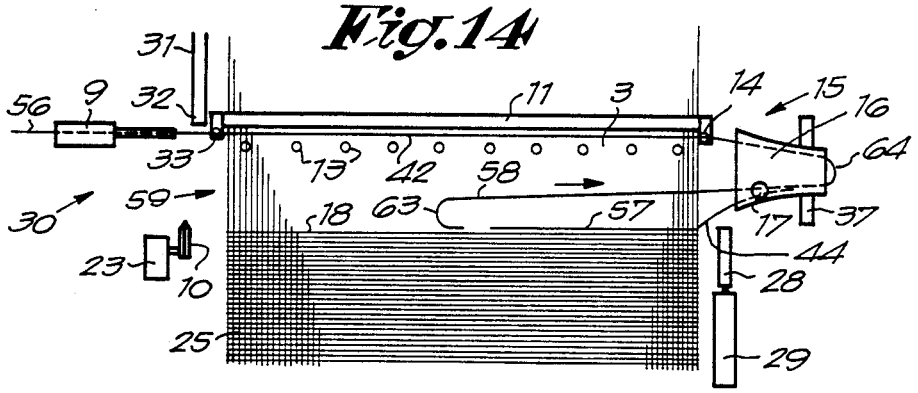

Subsequently as shown in FIG. 13 a quantity of weft thread 56 is inserted in the shed, where in the first place aforementioned piece of weft thread 58 is pulled free in the form of a loop 63, and is carried together to the end 15 of the shed 3. The arrival of the released piece of weft thread 58 can as shown in FIG. 14 for example be detected by means of the third weft detector 37. As further illustrated in FIG. 14, the second weft detector 17 is also used here in order to detect whether the piece of weft thread 58, on the one hand, has been entirely removed, or on the other hand, still has the loops 63 and/or 64 illustrated in FIGS. 13 and 14.

Figure 15:
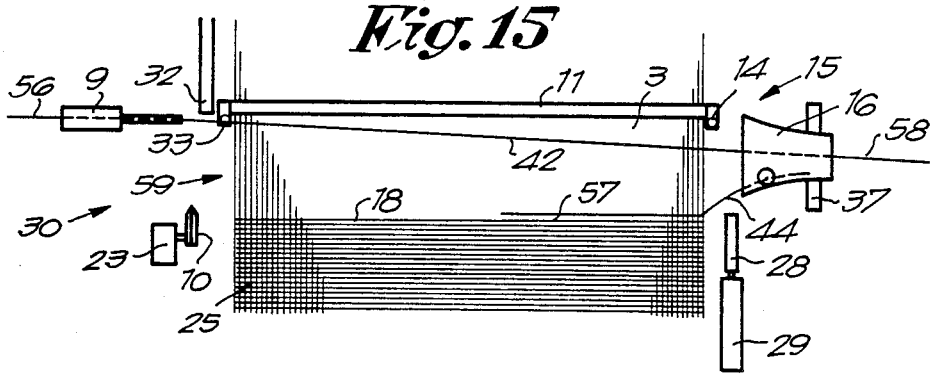

Finally a situation is arrived at as shown in FIG. 15, where the inserted quantity of weft thread 56 and the piece of weft thread 58 extends through the entire length of the shed 3 and past the suction nozzle 16. The release in the form of a loop 63 and removal of the piece of weft thread 58 by the insertion of a quantity of weft thread 56 has been known until now from Dutch patent application No. 8602191 of applicant.

Figure 16:
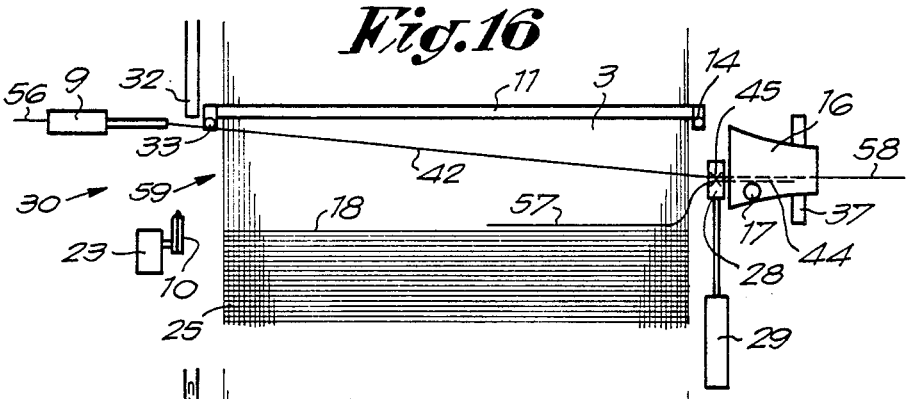
Figure 17:
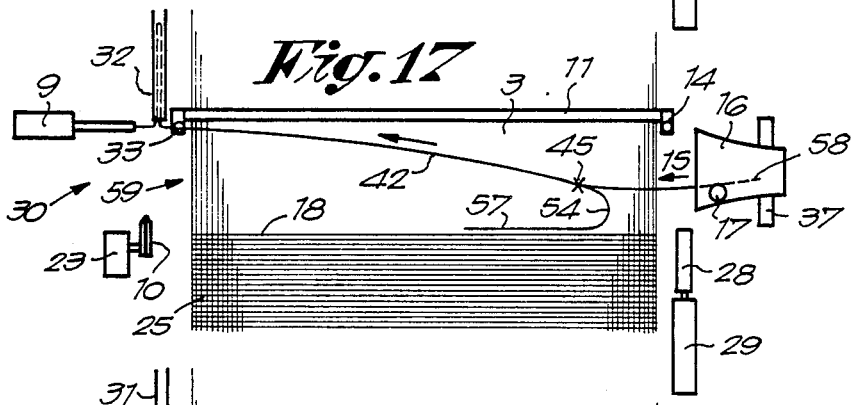

The special nature of the current invention consists of the fact that in combination with the foregoing the incorrect loose piece weft thread 57 is also released and removed from the shed 3 in the form of a loop. The quantity of weft thread 56 inserted in the shed as described above after all forms a pulling thread 42 when stretched. In a first possibility the pulling thread 42 obtained as shown in FIG. 15, is at the end 15 of the shed 3 fastened to the incorrect piece of weft thread 57 by means of the fastening apparatus 28, as shown in FIG. 16. After the fastening 45 has been created, the pulling thread 42 is withdrawn, for example by sucking this into suction nozzle 32, so that as illustrated in FIG. 17 the incorrect piece of weft thread 57 is removed from the shed in the form of a loop 54, analogous to that for the piece of weft thread 40 in FIG. 10. The threads sucked into the suction nozzle 32 are then cut free in a similar manner to FIG. 11.

Figure 18:
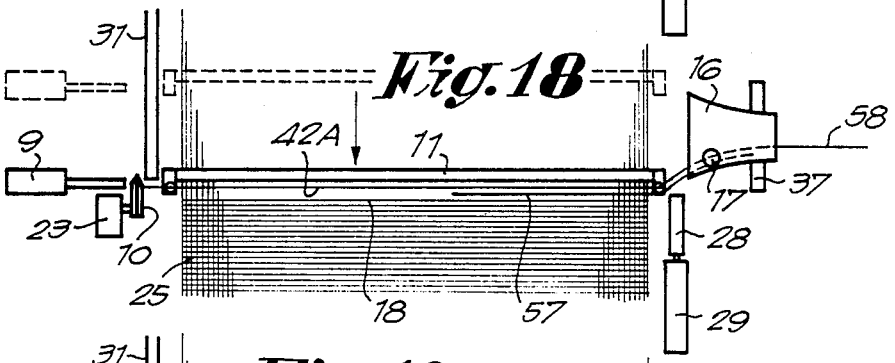

Although, on the one hand, the quantity of weft thread 56 inserted in accordance with the steps of the method as shown in FIGS. 13, 14, and 15 can be used as pulling thread 42, it is obvious that, on the other hand, this quantity of weft thread 56 can also be first cut and removed after which a new pulling thread can be inserted. The details of this are clarified below with reference to FIGS. 18 and 19. Here the piece of thread created by the release of the piece of weft thread 58 is referred to by reference 42A. This piece of thread 42A can be cut off because after a situation as shown in FIG. 15 the batten 19 is moved forward until the relevant piece of thread 42A is in range of the weft cutter 10, upon which the latter is operated. It will be obvious that, as indicated in FIG. 18, the reed 11 is not moved as far as the fell line 18 in order to prevent the piece of thread 42A being beaten up.

Figure 19:
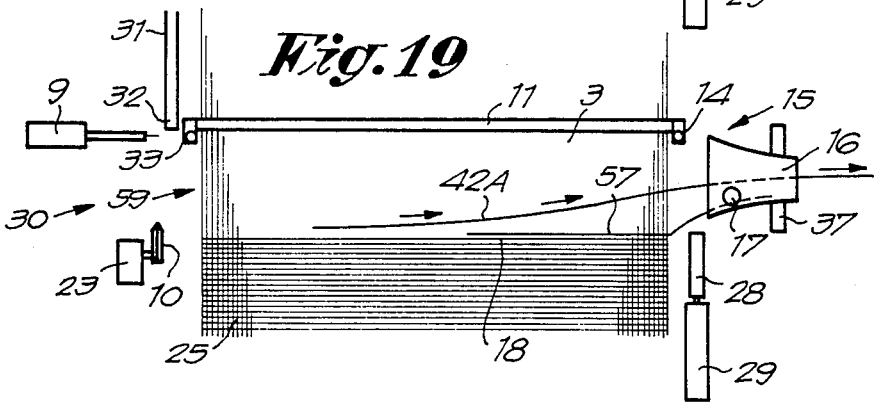

Once that the piece of thread 42A is cut loose from the thread supply 4 and the reed 11 is moved back, this piece of thread 42A will be removed by the suction nozzle 16, as illustrated in FIG. 19. Finally a new quantity of weft thread 56 is inserted in the shed 3 in order to create a pulling thread 42, with which, in similar manner as for the incorrect loose piece of weft thread 40 as described with reference to FIGS. 4 to 11 inclusive, the piece of weft thread 57 can be released.

It will be appreciated that the pulling thread 42 can also be obtained from a special thread supply provided for this purpose, which has nothing to do with the conventional thread supplies 4, 4A, 4B.

In FIG. 20 yet another variant of the invention is show, in which a thread carrying device 65 is installed next to the end 15 of the shed 3, for example of the type described in Belgian patent application No. 8700223 of applicant. Here a motor 66 unrolls a spirally rolled thread carrying element 67, consisting for example of a moderately stiff tape of synthetic material, and pushes it from end 15 through the suction nozzle 16 into the shed 3.

The thread carrying element 67 is provided on its front end with a thread clip 68 which can operate in conjunction with the piece of weft thread 61. As the piece of weft thread 61 is tensioned and positioned by means of the counter nozzle 27 it can be easily gripped.

Figure 21:
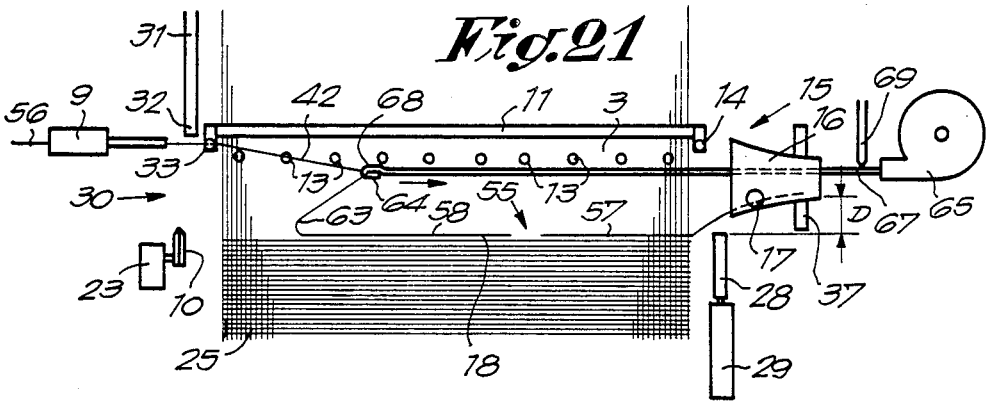

As illustrated schematically in FIG. 21, on the return movement of the thread carrying element 67 a quantity of weft thread 56 is pulled into the shed 3, thus creating a pulling thread 42 and releasing the incorrect piece of weft thread 58 from the fell line 18.

Figure 22:
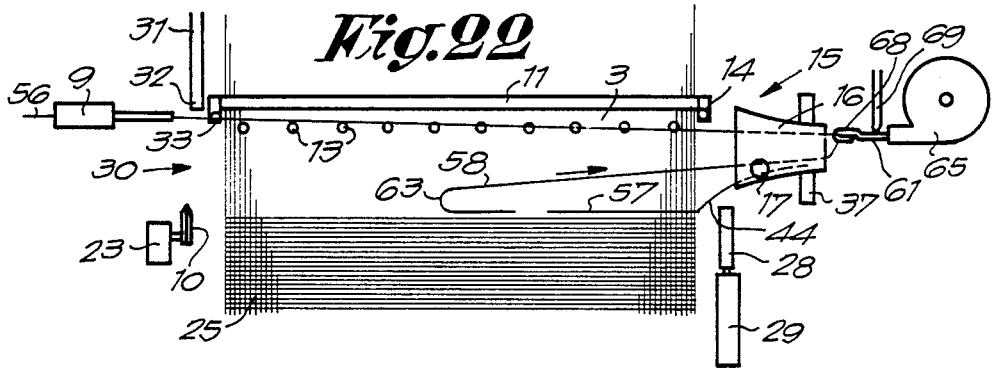
Figure 23:
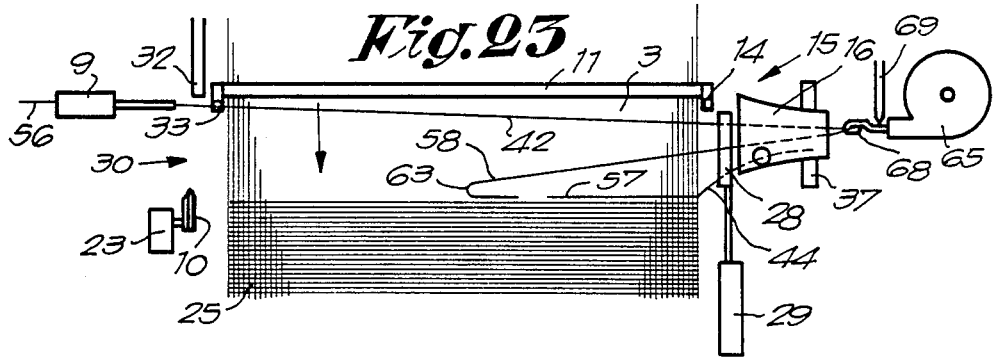

FIG. 22 shows the situation in the following stage. In FIG. 23 the thread carrying element 67 is entirely rolled up and the thread clip 68 is in contact with a striker 69, it being so arranged that the thread clip 68 is opened, but continues to form a hook or eye shaped thread guide element for the released, or still to be released piece of weft thread 58.

The operation of the thread clip 68 is shown in FIGS. 24 and 25. The thread clip 68 here consists chiefly of a lever 70 which works with one end 71 in conjunction with the inner wall of a hook-shaped part 72. The thread clip is normally closed by means of a spring 73. It should be noted that in FIGS. 20 to 23 inclusive and in FIGS. 26 and 27 the thread clip 68 and the striker 69 are for the sake of clarity only shown schematically.

In FIG. 24 it is clear that a thread which comes behind the hook-shaped part 72, will also be firmly held under the lever 71.

FIG. 25 shows the situation which arises when the thread clip 68, and in particular the lever 70 makes contact with the striker 69, where the clamped piece of weft thread 58 is released but remains capable of motion behind the hook-shaped part 72.

As once again llustrated in FIG. 23 the fastening apparatus 28 is presented to the created pulling thread 42 and the piece of weft thread for removal 57, after which a fastening 45 is made so that the situation becomes as shown in FIG. 26.

By drawing the pulling thread 42 from the weft insertion side 30 from the shed the piece of the weft thread 57 is released in the form of a loop 54. The piece of the weft thread 58 is also further released in the form of a loop, as this is necessary because of the arrangement concerned in order to pass behind the hook-shaped part 72. It is obvious that ultimately all threads, in other words the pulling thread 42, the incorrect piece of weft thread 57, as well as the incorrect piece of weft thread 58 will be sucked up in the suction nozzle 32, after which these sucked up threads can be cut free of the thread supply 4.

It will be clear that the invention is not restricted to airjet weaving machines. The method for removing a loose incorrect piece of weft thread 40 or 57 from the shed by means of a thread carrying device 65 can be applied to every type of weaving machine, thus for example gripper weaving machines as well.

On gripper weaving machines the preference, however, goes to making use of the grippers themselves to pass the pulling thread 42 through the shed. To clarify this various details for a gripper weaving machine are described with reference to FIG. 28 to 41 inclusive.

Figure 28:
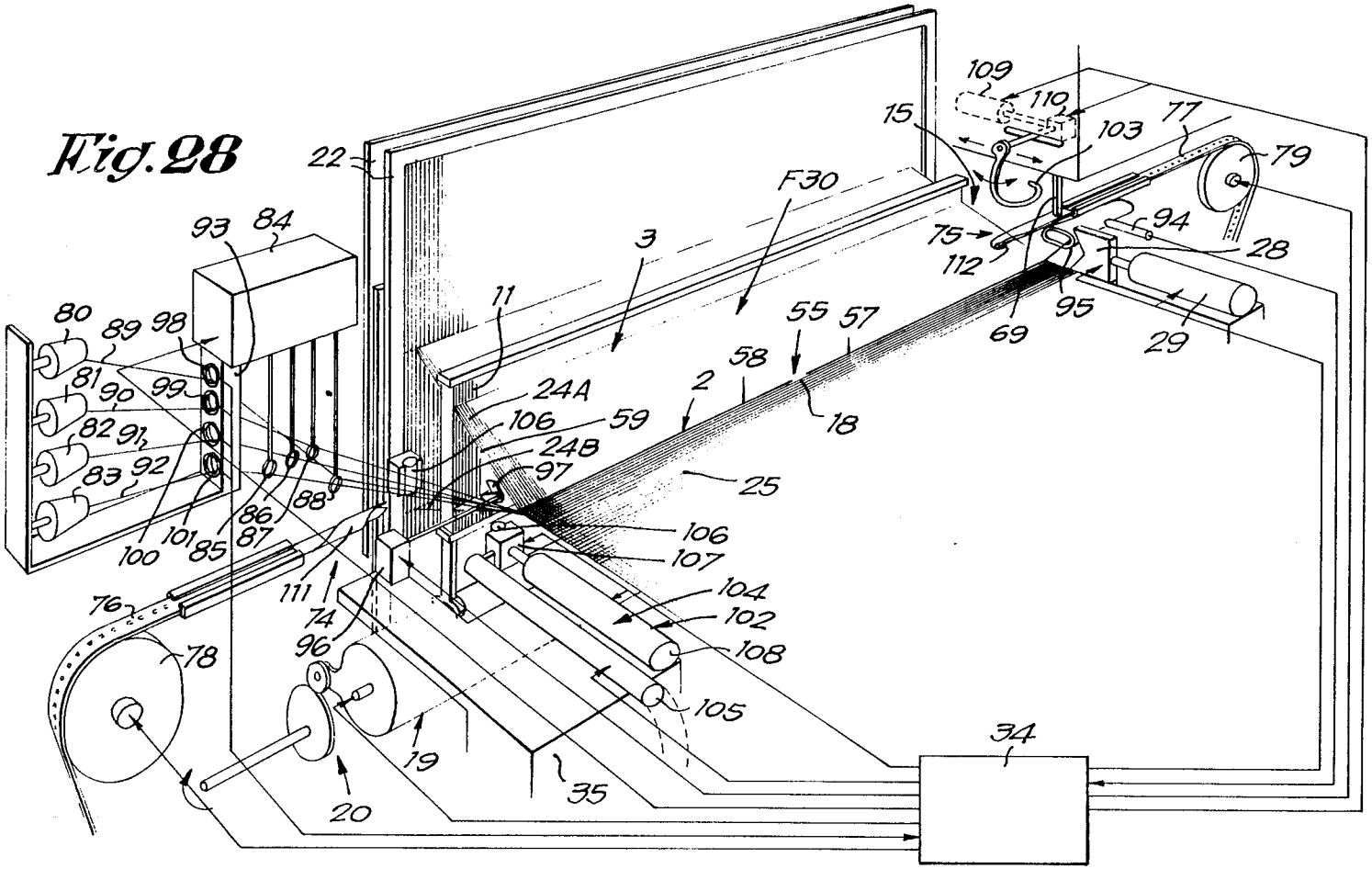

In FIG. 28 the shed 3 of a gripper weaving machine and the apparatus situated around it are shown. In this figure the feeder gripper 74, the carrier gripper 75, their respective lances 76 and 77, the lance drives 78 and 79, a number of thread supplies 80 to 83 inclusive, the thread presentation mechanism 84 with the respective thread guiding elements 85 to 88 inclusive, the batten 19 with the reed 11 and healds 22 are shown.

Also in FIG. 28 there are the respective weft threads 89 to 92, the most recently inserted length of weft thread 2, the upper and lower warp threads 24A and 24B, the fabric 25, the fell line 18, a first weft sensor 93, a second weft sensor or weft detector 94, a suction nozzle or some other means 95 for keeping the end 44 of a weft thread 2 stretched and a known cutter 97 driven by a driving means 96 indicated diagramatically in the figure for cutting the weft threads 89 to 92 inclusive at the start of their respective insertion in the shed.

The first weft detector 93 is located in front of the shed 3 and consists primarily of detectors 98 to 101 inclusive which operate in conjunction with respectively weft threads 89 to 92 inclusive. These are of the type that can detect the motion of the threads concerned, such that the supplied signal indicates the fact that either the weft thread 2 is correctly inserted, or that the weft thread 2 has broken during insertion or has prematurely come free of one of the grippers.

The second weft detector 94 is of the type that can detect the presence of a thread and is intended for detecting broken weft threads or long weft threads and is therefore located at a little distance beyond the end 15 of the shed 3.

As further indicated in FIG. 28 a number of accessories are provided which can be controlled in a suitable manner by means of a control unit 34, such as the fastening apparatus 28, means 102 for drawing the weft threads from the shed, and a movable thread guiding element 103 in the form of a hook. Means 102 consist primarily of a combination of a mechanical thread removal device 104 and a suction nozzle 105. The device 104 consists primarily of two rollers 106 provided with at least one driving motor 107, which in the rest condition are located apart from one another next to the front end 59 of the shed 3 and which can be placed against one another by a drive 108 such as a pneumatic cylinder, this being arranged such that by their rotation a thread held between them can be withdrawn from the shed 3. Aforementioned suction nozzle 105 can together with the movable roller be moved and is situated with its front end next to the relevant roller.

The movable thread guide element 103 consists of a hook which can by means of a driving means 109 and 110 execute a translational and a rotational movement, as further described below.

It will be obvious that the feeder gripper 74 and the carrier gripper 75 are provided at their extreme ends with thread clips 111 and 112 known independently. As illustrated in FIG. 29 the thread clip 111 consists primarily of a lever section 113 which at one end works in conjunction with a fixed gripping surface 114, with the assistance of elastic means 115. Aforementioned thread clip 112 is in principal identical as shown in FIGS. 24 and 25. In the following description consequently the same references are employed, respectively for the lever 70, the extreme end 71, the hook shaped part 72 and the spring 73. Also the striker 69 mentioned above is again used in this variant.

Gripper mechanisms are for example known from Belgian Pat. No. 904.862 of applicant.

Figure 30:
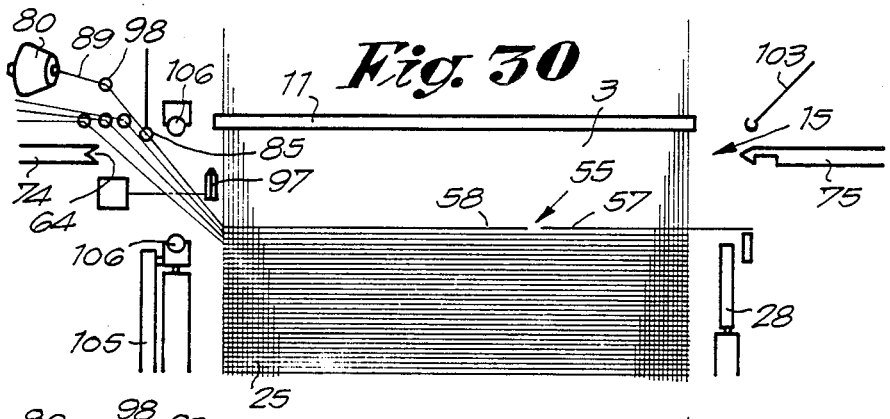

In FIGS. 28 and 30 a thread break 55 has occurred as a result of which as in FIG. 12 a loose incorrect piece of weft thread 57 and a piece of weft thread 58 connected to the weft thread supply, 80 in this case, have been formed.

A method is schematically illustrated in FIGS. 31 to 35 inclusive where only the loose incorrect piece of weft thread 57 is removed in accordance with the invention. As a result of the break 55 the thread detector 98 gives a signal during the insertion of the weft thread 2 that indicates an error. At the end of the insertion the thread detector 94 is also activated by the thread which has been inserted too far. As a result of the combination of the two signals the control unit 34 controls the thread presentation mechanism 84 in such a way that in the first case none of the weft threads 89 to 92 inclusive are placed in the course of the feeder gripper 74. The normal weaving process is interrupted by this and the beaten-up incorrect weft thread 2 is released by undoing the binding of the warp threads, that is to say if this binding has been effected, by means of the known pick finding.

Figure 31:
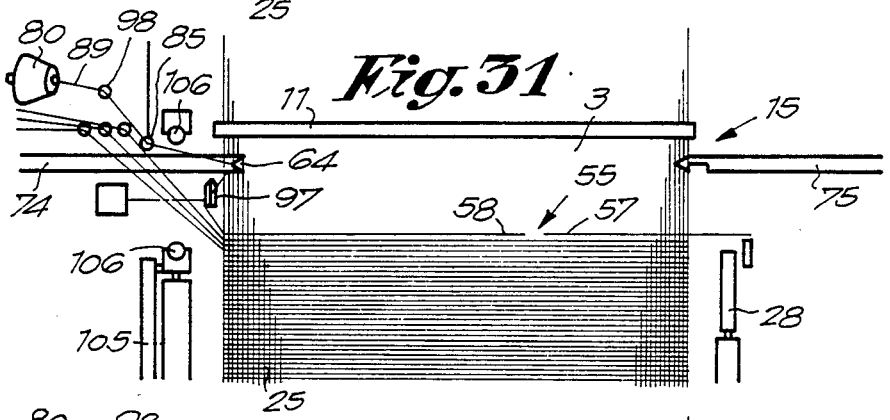
Figure 32:
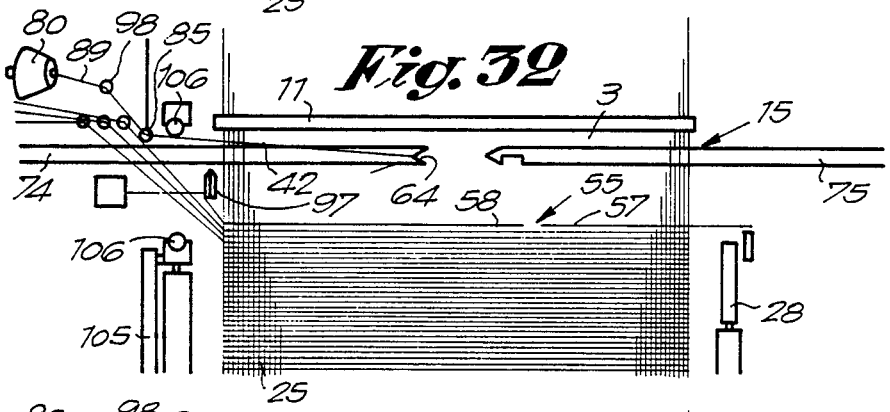
Figure 33:
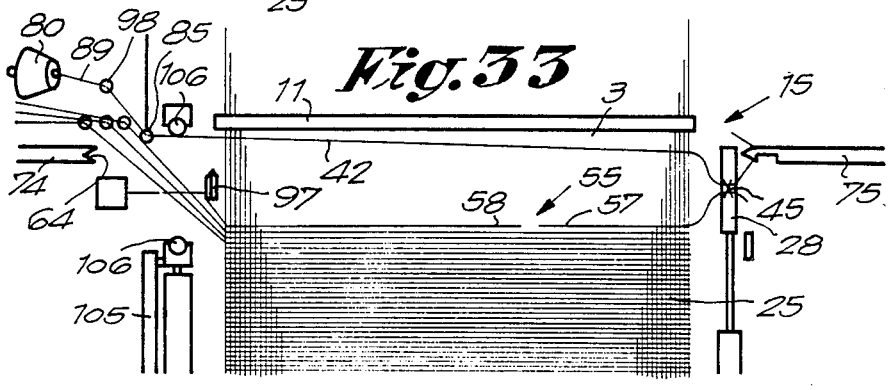

Subsequently a quantity of weft thread, from one of the thread supplies 80 to 83 inclusive are inserted in the usual manner in the shed, respectively as shown in FIGS. 31 to 33 inclusive. In the shown embodiment the same weft thread 89 is used for this purpose. The inserted quantity of weft thread 89 forms in analogous manner to aforementioned embodiments a pulling thread 42.

As shown in FIG. 33 the loose incorrect piece of weft thread 57 is fastened in similar manner to the embodiments discussed above to the end of pulling thread 42 near the end 15 of the shed 3.

Figure 34:
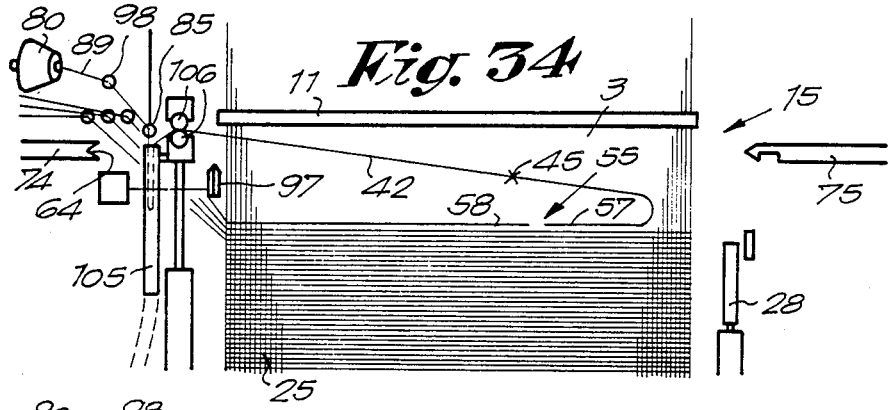

FIG. 34 shows how the pulling thread 42 together with the piece of weft thread 57 knotted to it can be removed from the shed 3. To this end aforementioned rollers 106 are presented to one another in such a way that the pulling thread 42 is gripped between them. By causing the rollers to operate the pulling thread 42 is drawn out of the shed 3 and sucked into the suction nozzle 105.

Figure 35:
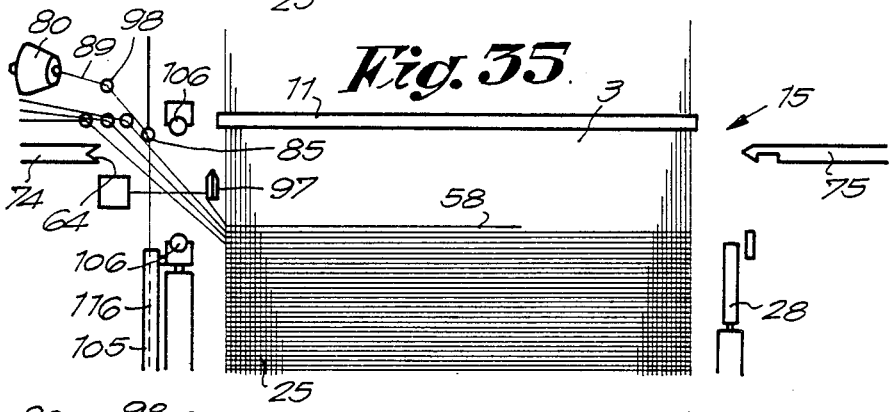

When the pulling thread 42 and the piece of weft thread 57 fastened to it have been sucked entirely into the suction nozzle 105, the suction nozzle 105 and the rollers 106 are returned to their rest position. The relevant weft thread 89 which was used as pulling thread 42 continues to be sucked into suction nozzle 105 as shown in FIG. 35. Suction nozzle 105 keeps the relevant thread stretched in the thread guide element 85, so that the relevant thread can be presented in the normal way to the feeder gripper 74 upon a following insertion. Upon the following insertion the thread waste 116 is automatically cut off by the cutter 97 and sucked up entirely into the suction nozzle 105.

FIGS. 36 to 41 inclusive show how according to the invention both pieces of weft thread 57 and 58 can by a repair procedure be simultaneously released from the fell line 18 and removed.

Figure 36:
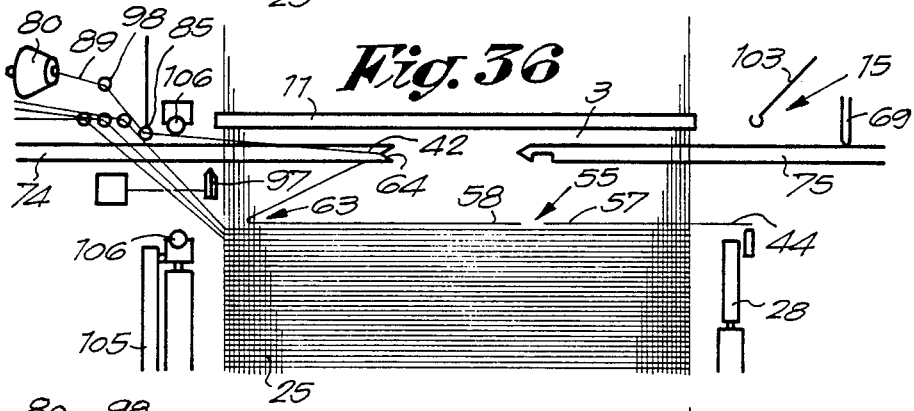

In that case the incorrect weft thread 2 is left connected to the relevant thread supply 80. A quantity of weft thread 89 from the same thread supply 80 is inserted. The special aspect of this is, as shown in FIG. 36, that measures have been taken to prevent the relevant weft thread 89 from getting in the cutter 87, by for example closing these so that the thread runs freely over them.

Figure 37:
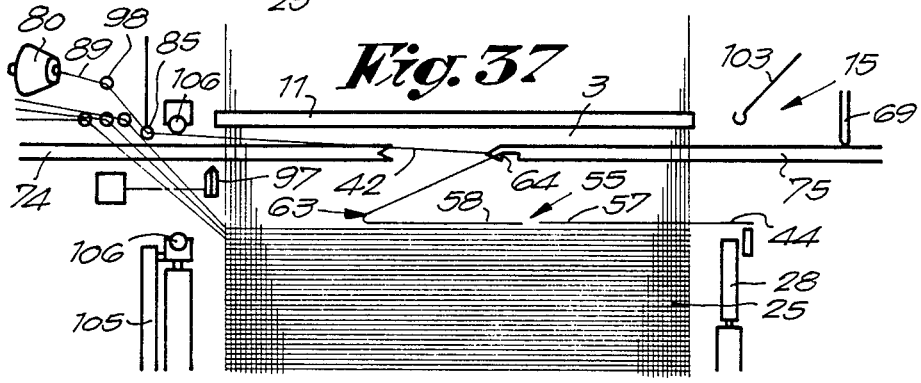

As a result of this the piece of weft thread 58 is released in the form of a loop 63 during the thread transport, in similar manner to what is shown in FIG. 13 in an airject weaving machine. It will be clear that, as shown in FIG. 37, a pulling thread 42 is formed.

Figure 38:
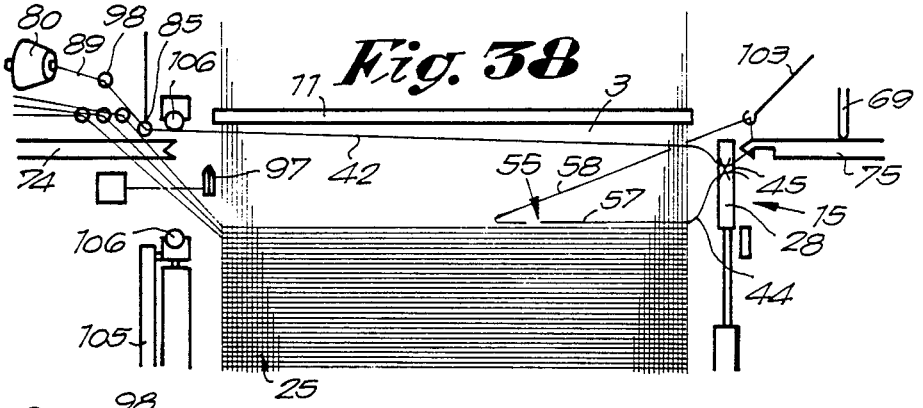

As shown in FIG. 38 the grippers 74 and 75 are in the first place not returned entirely to their extreme positions, so that the pulling thread 42 and the weft thread 58 connected to it remains gripped in the carrier gripper 75 so that knotting by means of the fastening apparatus 28 is simplified. The partly released or otherwise incorrect piece of weft thread 58 can then for example be gripped by means of a thread guide element 103 and pulled to one side, so that in particular as illustrated in FIG. 38, the fastening apparatus 28 can only be presented to the piece of weft thread 57 and the pulling thread 42, in order to realize a fastening 45 as aforementioned.

Aforementioned thread guiding element 103 may consist of any hook-shaped element, which can take just one thread, namely the piece of weft thread 58, close to the carrier gripper 75. A similar hook-shaped element and its drive is for example described in Dutch patent application No. 86 02826 of applicant.

It is clear that a hook-shaped element with a drive, which allows the correct thread to be pulled to one side can be produced in any form whatsoever.

Figure 39:
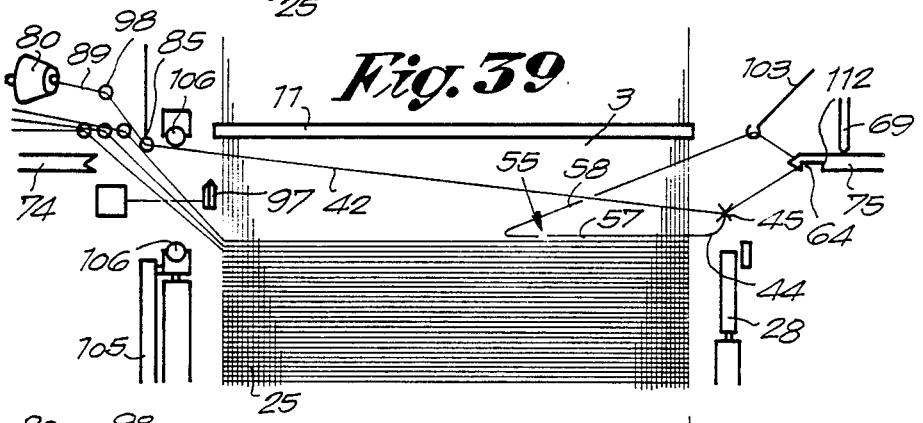

After the realization of the fastening 45 the grippers 74 and 75 are moved further from one another, whereby as schematically indicated in FIG. 39 the thread clip 112 comes into contact with the striker 69 which pushes the thread clip 112 open, so that the relevant weft thread 89 is no longer gripped by the loop 64. The pressing open of the thread clip 112 takes place in analogous manner to that illustrated in FIG. 25.

Figure 40:
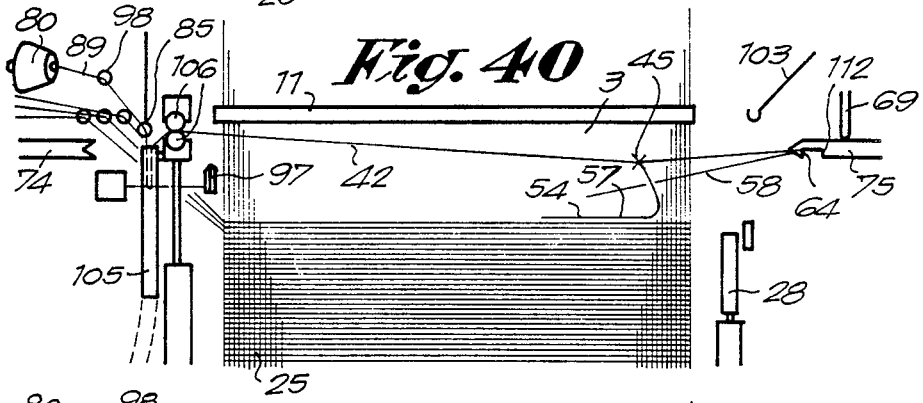

Once the fastening 45 has been realized the pulling thread 42 can once again be released by the thread guiding element 103. By operating the thread removal device 104, the pulling thread 42 and the pieces of weft thread 57 and 58 are, as illustrated in FIGS. 40 and 41, removed in similar manner as in FIG. 27 from the shed 3, after which a situation similar to that in FIG. 35 arises.

In FIGS. 42 to 44 inclusive a special possibility is illustrated whereby a piece of weft thread 117, which finds itself with one end 118 beyond the end 59 of the shed 3 located on the weft insertion side 30, is removed in accordance with the method of the invention. To this end use is made of a thread carrying device 65 located on the weft insertion side 30 next to the shed 3, as well as a separate thread supply 119, for example consisting of especially strong thread, which is located next to the other end 15 of the shed 3 or which can be presented in the vicinity thereof. The means 102 for removing the thread out of the shed are in that case located at the end 15 of the shed 3.

In the rest state the free end of the thread of the separate thread supply 119 is held stretched in the suction nozzle 105. A thread brake 120 prevents the suction nozzle 105 from immediately sucking up the thread from the thread supply 119.

As shown in FIG. 42 the thread carrying element 67 takes the thread from thread supply 119.

By withdrawing the thread carrying element 67 a pulling thread 42 is formed which is fastened by means of the fastening apparatus 28, which in this case is located at the weft thread insertion side 30 next to the shed 3, to weft thread piece 117, in particular in the manner shown in FIG. 43.

After this, as shown in FIG. 44, the thread removal device 104 is activated, causing the pulling thread 42 with the piece of weft thread 117 fastened to it to be removed from end 15 of the shed 3, where the release of the piece of weft thread 117 takes place in a loop form 54. The waste thread is sucked up into the suction nozzle 105 and cut free by means of a cutter 121 or similar.

It will be obvious that other devices for removing the threads from the shed can be used than those described above. Aforementioned thread removal device 104 or the suction nozzle 32 can of course be used as preferred in the devices described above.

It will be obvious that the method according to the invention can also be used for removing from the shed weft threads 2 which extend over the entire length of the shed and which have already been disconnected from the thread supply.

Of course the pulling thread 42 and the piece of weft thread 57 knotted to it outside the shed at the end where it is to be drawn can be guided back over a hook shaped element to pass back through the shed. In this way aforementioned means 102 can be installed at the same end of the shed as where the fastening 45 is realized.

The current invention is by no means limited to the embodiments described here by way of example and reproduced in the figures, but instead can be carried out in various different ways without going beyond the scope of the invention.

I claim:

1. A method for removing from the shed of a weaving machine a loose weft thread which is not bound in by warp threads and which extends across a length of the shed to a first end of the shed, comprising the steps of:

(a) inserting a weft thread into the shed and transporting it through the shed until it extends over the entire length of the shed, thereby forming a pulling thread;

(b) fastening, outside the shed, the loose weft thread to said pulling thread;

(c) drawing, from the end of the shed located opposite the end where the loose weft thread has been fastened to said pulling thread, the pulling thread together with the loose weft thread in such a way that the loose weft thread is released from the fell line in the form of a loop and removed from the shed.

2. A method as claimed in claim 1 wherein the step of fastening is realized immediately adjacent the first end of the shed.

3. A method as claimed in claim 1, wherein, in the event of a thread break resulting in the creation of two incorrect pieces of weft thread, a first of said incorrect pieces of weft thread closest to the weft insertion side of the shed being left connected to the thread supply and the second of said incorrect pieces being loose, a quantity of weft thread from the weft insertion side is transported through the shed so that said first piece of thread connected to the thread supply is released in the form of a loop to thereby create the pulling thread, and wherein the step of fastening is realized between the pulling thread created by the action of release in the form of a loop and the second of said incorrect pieces of weft thread in order to remove both incorrect pieces of thread from the shed.

4. A method as claimed in claim 1, wherein said weaving machine is an air jet weaving machine and the step of inserting a pulling thread is carried out by means of the main nozzle of the air jet weaving machine.

5. A method as claimed in claim 1, wherein said weaving machine is a gripper weaving machine and said step of inserting the pulling thread is carried by means of grippers.

6. A method as claimed in claim 1, wherein said step of inserting the pulling thread is carried out by means of a thread carrying device.

7. A method as claimed in claim 3, wherein said step of insertion is carried out by means of a thread carrying device located next to the shed opposite to the weft insertion side, said step of insertion comprising the steps of passing the thread carrying element through the shed, gripping the weft thread at a position located between the main nozzle and the fell line by the thread carrying element, and drawing the weft thread through the shed by the return movement thereof.

8. A method as claimed in claim 3, wherein, following the step of insertion, the first of said incorrect pieces of weft thread and the inserted weft thread in the form of a loop connected to it are passed through the shed until a pulling thread is formed, the second of said incorrect pieces of weft thread to be removed is fastened to the pulling thread which extends between said loop and the thread supply, and the first incorrect piece of weft thread which is left connected to the thread supply is then led over a thread guide element, in such a way that the first incorrect piece of weft thread is also released from the fell line in the form of a loop and removed from the shed during the withdrawal of the pulling thread from the shed.

9. A method as claimed in claim 1, wherein said weaving machine includes a plurality of thread supplies and wherein, in the event of a break, the pulling thread is formed by a weft thread selected from a thread supply other than the thread supply from which the loose weft thread was drawn.

10. A method as claimed in claim 1, wherein the pulling thread is supplied from a separate thread supply containing thread which is stronger than the thread from the normal thread supply.

11. A method as claimed in claim 1, wherein said step of drawing is carried out by means of a suction nozzle.

12. A method as claimed in claim 1, wherein said step of drawing is carried out by means of a mechanical thread removal device.

13. A method as claimed in claim 1, wherein said step of fastening includes the step of knotting the pulling thread and the loose weft thread to one another.

14. A method as claimed in claim 1, wherein said step of fastening includes the step of splicing said pulling thread together with said loose weft thread.

15. A method as claimed in claim 1, wherein said step of fastening includes the step of using a fastening agent to fasten the pulling thread to the loose weft thread.

16. A method as claimed in claim 15, wherein said fastening agent includes a fast-setting adhesive.

* * * * *